United States Patent [19]

Nauheimer

[11] 4,278,170

[45] Jul. 14, 1981

[54] CUSHIONING INSERT FOR FRANGIBLE OBJECTS

[75] Inventor: James F. Nauheimer, Chicago, Ill.

[73] Assignee: Container Corporation of America, Chicago, Ill.

[21] Appl. No.: 122,878

[22] Filed: Feb. 14, 1980

[51] Int. Cl.[3] ..... B65D 85/42

[52] U.S. Cl. ..... 206/422; 206/419; 206/589

[58] Field of Search ..... 206/422, 419, 420, 426, 206/589

[56] References Cited

U.S. PATENT DOCUMENTS

| | | | |
|---|---|---|---|
| 3,494,534 | 2/1970 | McFarland et al. | 206/422 |
| 3,955,675 | 5/1976 | Kurtz | 206/422 |
| 4,018,335 | 4/1977 | Jacob et al. | 206/419 |
| 4,068,793 | 1/1978 | Gardner | 206/422 |
| 4,088,225 | 5/1978 | Hartnell | 206/419 |
| 4,131,198 | 12/1978 | Fischer | 206/419 |

*Primary Examiner*—Joseph Man-Fu Moy

*Attorney, Agent, or Firm*—Richard W. Carpenter; Davis Chin

[57] ABSTRACT

A cushioning insert for a plurality of frangible objects such as video tubes packed in a shipping container is disclosed. The viewing screens of the tubes are isolated from the corners of the shipping container, and the necks of the tubes are arranged in pairs in separate planes in intersecting relationship along a center post partly supporting a platform having cutouts therein locating the tube envelopes.

12 Claims, 12 Drawing Figures

CUSHIONING INSERT FOR FRANGIBLE OBJECTS

SUMMARY OF THE INVENTION

The insert according to the present invention enables a plurality of video tubes (preferably four in number) to be packaged in a conventional shipping container in such a fashion that the viewing screens are isolated from the corners and sides of the container, where possible injury to the tubes is most prevalent. The neck portions of the tubes are arranged against a center post partly supporting the tube envelopes, a pair of tubes bearing against opposed sides of the center post, and the other pair of tubes bearing against other opposed sides of the center post and in an upper plane isolated from the plane of the first pair of tubes.

THE DRAWINGS

DESCRIPTION OF THE INVENTION

Figure 2:
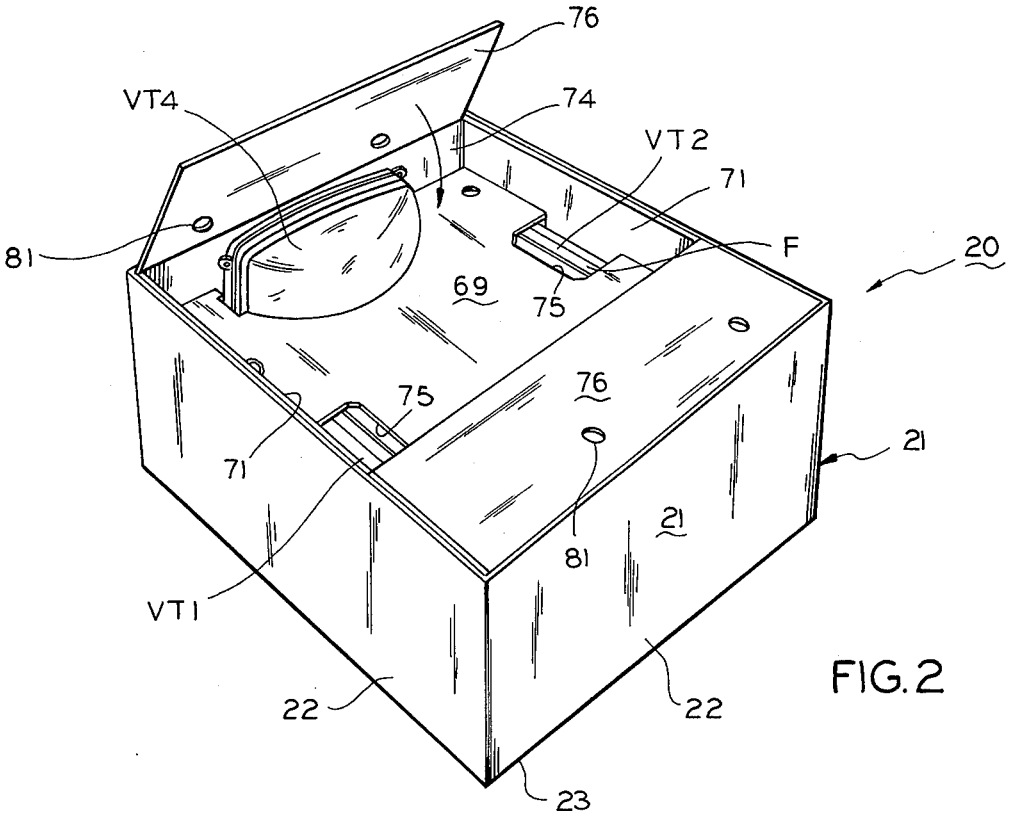
FIG. 2 is a view similar to FIG. 1 with the container cover removed.
Figure 1:
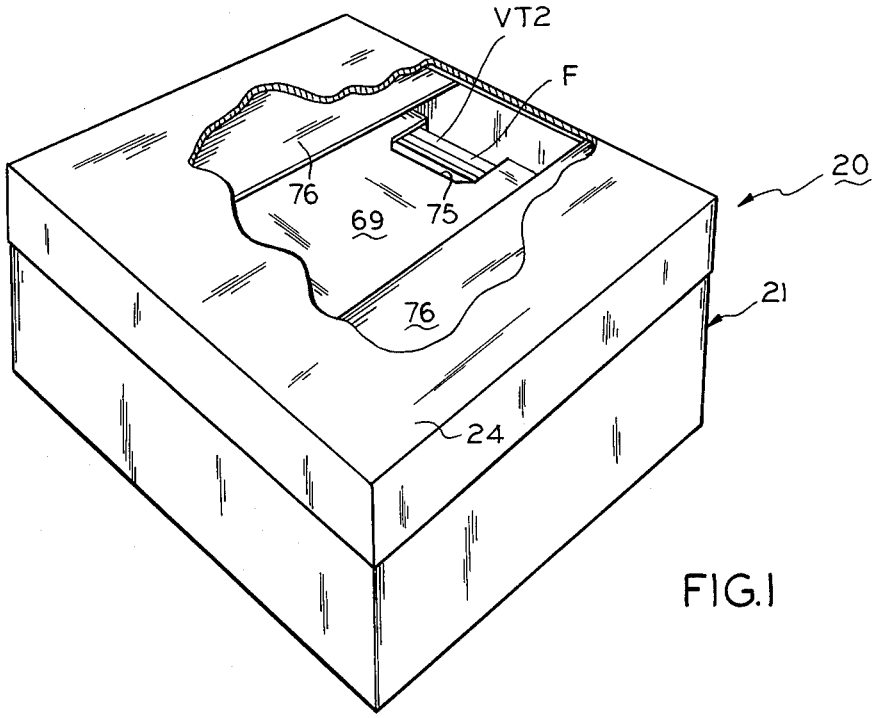
FIG. 1 is a perspective view of a shipping container having the insert of the present invention enclosed therein, part of the container cover being broken away to show certain details of the insert.
Figure 3:
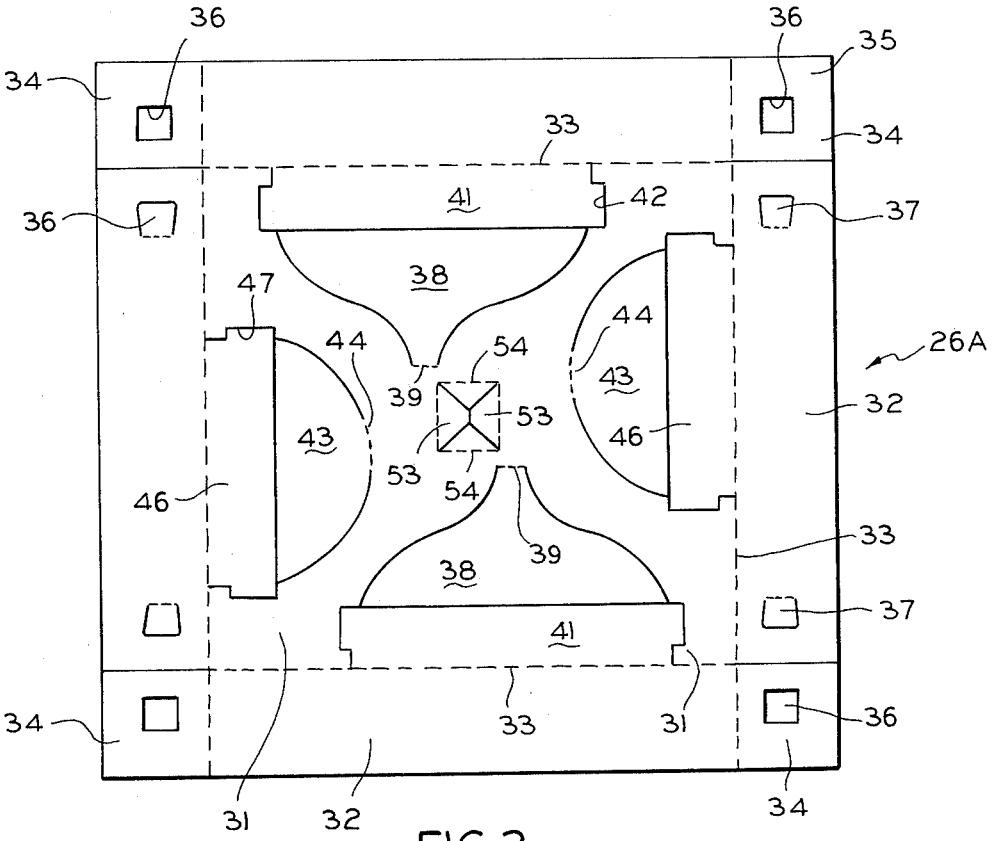
FIG. 3 is a plan view of a cut and scored blank for forming a platform supporting a number of video tubes.

The invention structure is denoted generally by the reference numeral 20 and is shown positioned in a shipping container 21 having side and end walls 22 and a bottom 23. A cover 24 is placed atop container 21.

Figure 5:
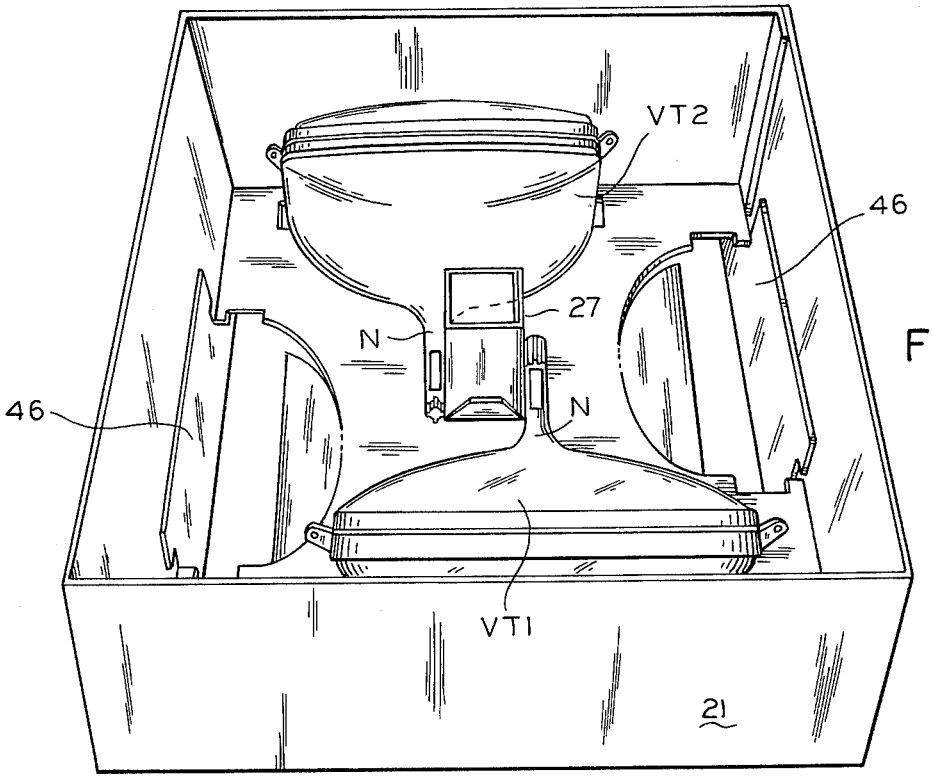
FIG. 5 is a perspective view showing the blank of FIG. 3 folded and erected within a shipping container with a pair of tubes positioned thereon.
Figure 6:
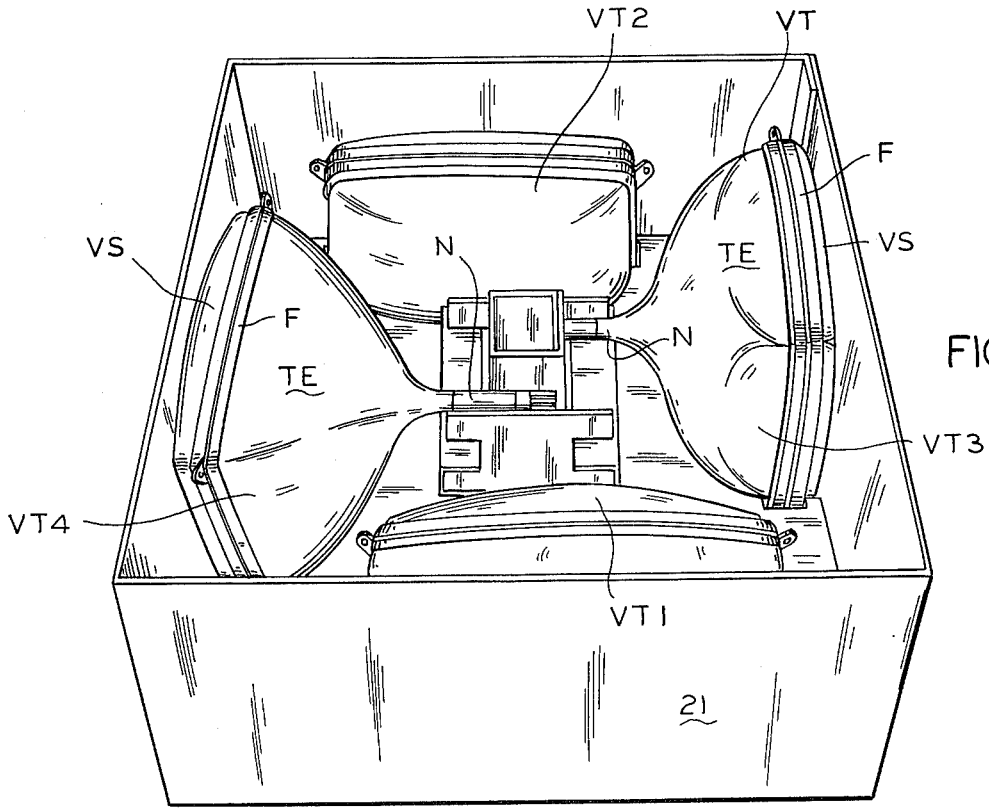
FIG. 6 is a view similar to FIG. 5, showing a second pair of tubes positioned thereon.

A plurality of video tubes VT are shown in the several views, each comprising a tube envelope TE with a viewing screen VS held to the envelope TE at a flange F. Each tube has a neck N. As seen in FIGS. 5 and 6, the individual tubes are denoted as VT1, VT2, VT3 and VT4.

A platform 26 for the several tubes is formed from a platform blank 26A and a center post 27 is formed from a blank 27A, there being a tube neck guide 28 formed from a blank 28A. An upper insert member 29 covering the tube array and also protecting the same is formed from a blank 29A.

Figure 4:
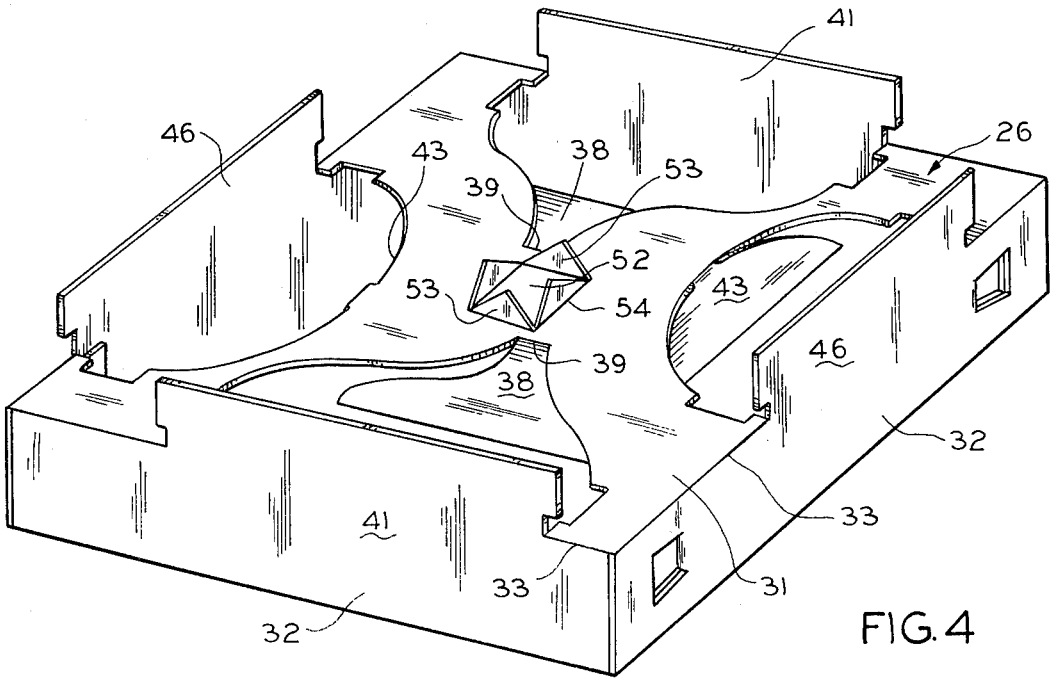
FIG. 4 shows the blank of FIG. 3 folded and erected to form a platform receiving the tubes.

As seen in FIGS. 4 and 5, platform 26 includes a panel 31 having opposed side and end flaps 32 foldable with respect to panel 31 along fold lines 33. The flaps 32 are folded downward to space panel 31 above a supporting surface such as the bottom 23 of shipping container 21. Flaps 34 at the ends of two of the flaps 32 have openings 36 therein cooperating with locking tabs 37 near the ends of the other opposed flaps 32 to lock all the flaps 32 in erected position.

The erected platform 26 has the panel 31 thereof provided with contoured cutout flaps 38 folded with respect to panel 31 along short fold lines 39, and flaps 41 cut from panel 31 which are erected to position upon folding of their adjacent flaps to provide protection for the viewing screens of tubes VT1 and VT2. The panel 31 is notched at 42 at the ends of flaps 41 to receive the flanges F of tubes VT1 and VT2. The contouring of the cutout flaps 38 provides support for the envelope VE of the tubes VT1 and VT2 as well as support of the envelope VE by the cutout flap 38.

In similar fashion panel 31 is cut out at contoured flaps 43 foldable with respect to panel 31 along short fold lines 44. Similarly, flaps 46 are erected. These furnish protection of the viewing screens of tubes VT3 and VT4. The contour of the openings at the flaps 43 gives support to the envelope VE of said tubes as well as support by the flaps 43.

All of the tubes will be cradled in panel 31 by reason of the flaps 38 and 43 cut therefrom. It will be noted that tubes VT1 and VT2 are disposed in reverse relationship as are also tubes VT3 and VT4.

Figure 7:
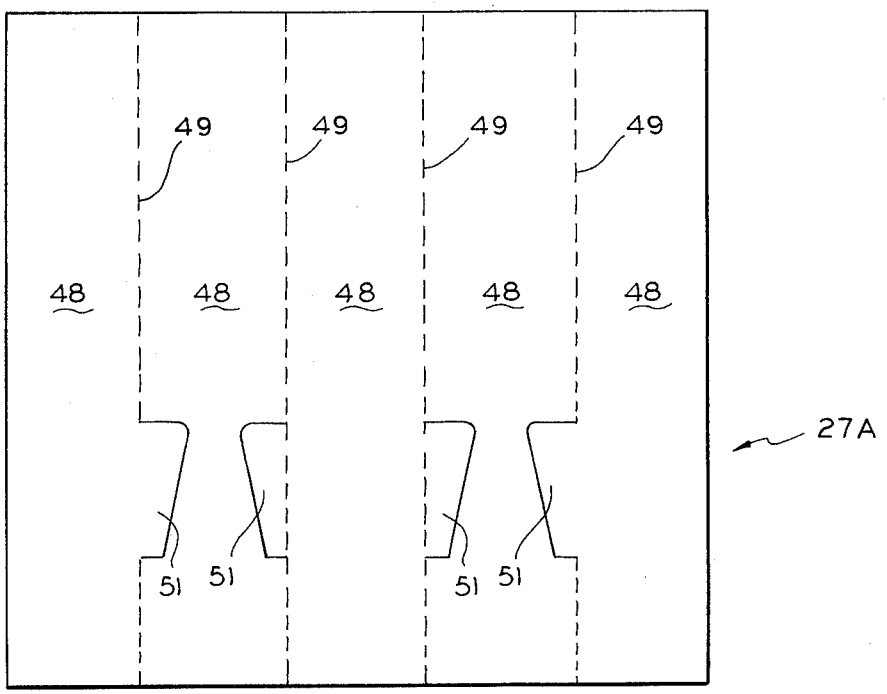
FIG. 7 is a plan view of a cut and scored blank for forming a center post partly supporting the platform seen in FIGS. 3 and 4.
Figure 8:
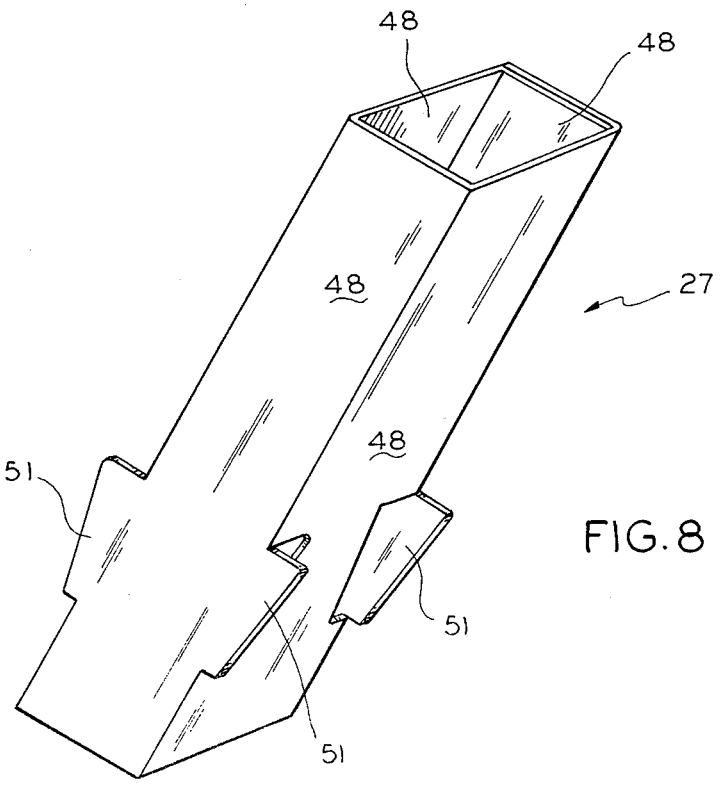
FIG. 8 is a perspective view showing the blank of FIG. 7 folded to form a center post partly supporting the platform seen in FIGS. 3 and 4.

Structure is provided for supporting panel 31 and for positioning the necks N of the tubes VT, and contemplates the center post 27 seen in FIG. 8, which is formed from the blank 27A seen in FIG. 7. Blank 27A consists of serially connected panels 48 connected along fold lines 49 and foldable into the shape of a tube of rectangular cross section. Support tangs 51 are formed in the panels 48 to extend outward from panels 48 to underlie panel 31. The center post 27 is inserted from the bottom of panel 31 through a rectangular opening 52, triangular shaped tabs 53 being formed thereat and folded upward along fold lines 54 alongside the panels of post 27.

Tubes VT1 and VT2 are placed in position as seen in FIG. 5 with necks N thereof flanking opposite panels 48 of post 27.

Figure 9:
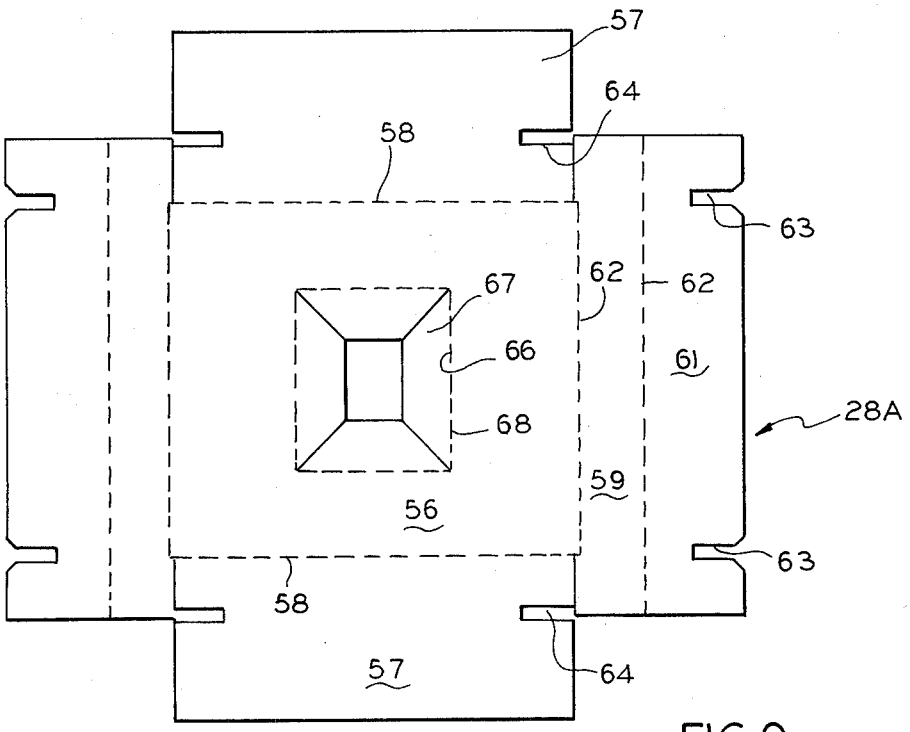
FIG. 9 is a plan view of a cut and scored blank for forming a guide for the necks of the tubes.
Figure 10:
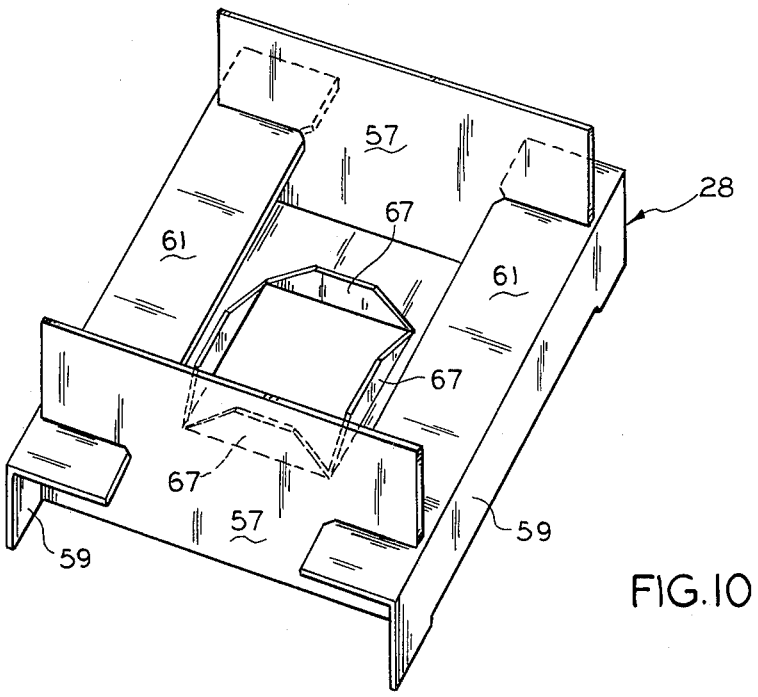
FIG. 10 shows the blank of FIG. 9 erected.
Figure 11:
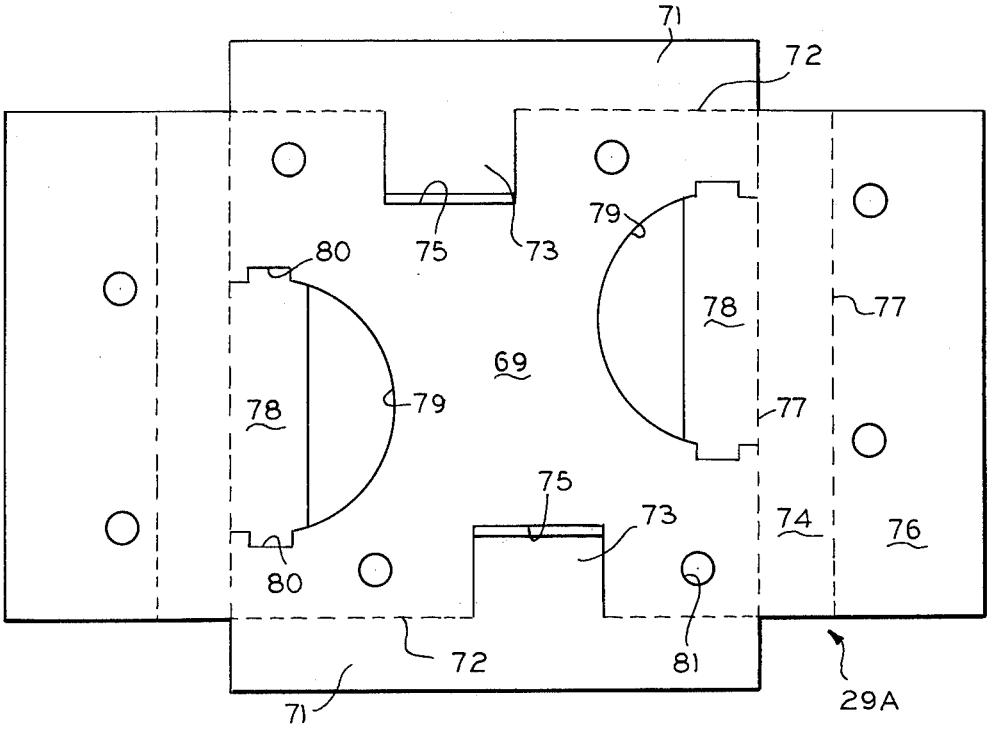
FIG. 11 is a plan view of a cut and scored blank for forming an upper insert member.

Guide 28, see FIGS. 9 and 10, for all of the necks N is formed from the blank 28A which includes main panel 56 flanked by end flaps 57 foldable with respect thereto along fold lines 58. Side locking flaps 59 and 61 are joined to each other and to main panel 56 along fold lines 62, and flaps 57 and 61 are provided with cooperating locking slots 63 and 64 to provide a walled structure made up of end wall flaps 51 and side wall flaps 59.

A rectangular opening 66 is provided in the center of panel 56 defined by folded up tabs 67 foldable upward along fold lines 68. The structure 28 seen in FIG. 10 is then placed about the center post 27 after tubes VT1 and VT2 are positioned. Those parts of panel 56 flanking center post 27 together with side flaps 59 and 61 act against the necks of tubes VT1 and VT2 to assist in holding them in place.

Tubes VT3 and VT4 are then positioned in the openings at cutout panels 43 and cutout flaps 46 with the necks N of tubes VT3 and VT4 placed against center post 27 and inside the walls 57 spaced therefrom to guide said necks.

It will be noted that the necks of tubes VT1 and VT2 lie in one plane, and that the necks of tubes VT3 and VT4 lie in a second plane, thereby saving considerable space. Moreover, the tubes of one plane intersect the tubes of the second plane, also saving space.

Upper insert member 29 is formed from blank 29A which consists of a main panel 69 flanked by end flaps 71 foldable upward with respect thereto along fold lines 72. A tab 73 formed with flap 71 is erected at that time to extend downward against the viewing screens of tubes VT1 and VT2. An opening 75 is thereby provided in panel 69 for the flanges F of such tubes.

Opposing side and top flaps 74 and 76 are foldable to each other and to main panel 69 along fold lines 77. When flap 74 is erected a tab 78 connected therewith is folded downward to lie alongside the viewing screen of tubes VT3 and VT4. Notches 80 are provided in panel 69 at such tabs 78 for the flanges F of such tubes.

Figure 12:
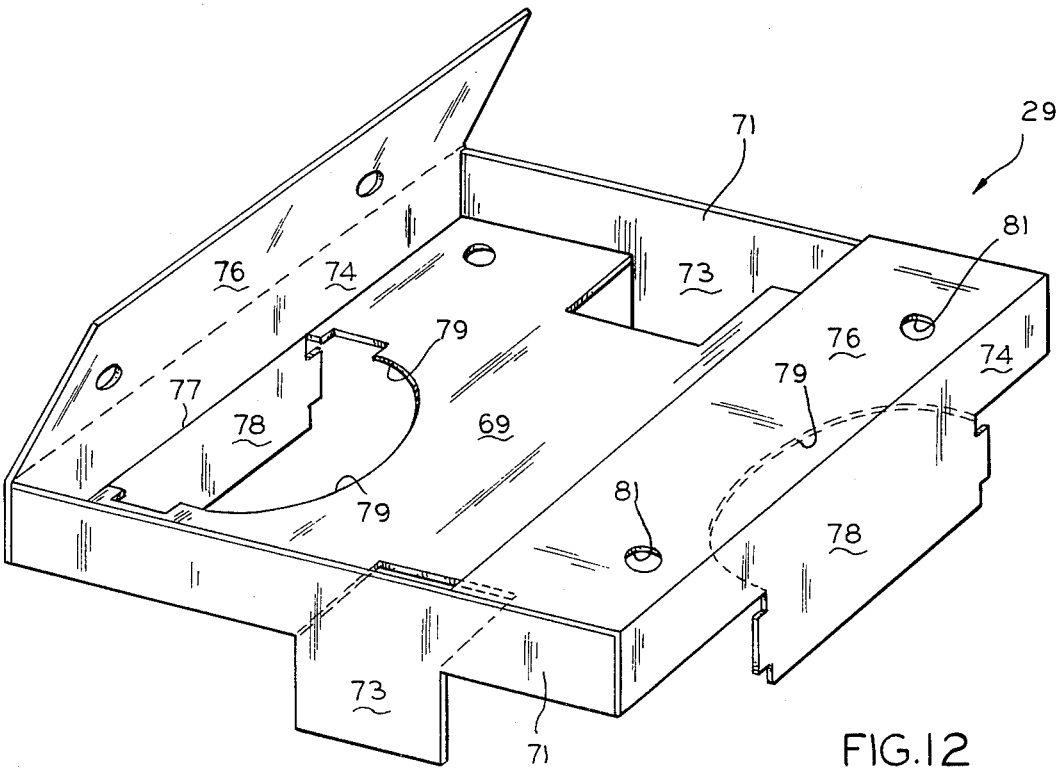
FIG. 12 shows the upper insert in erected position.

Top flap 76 is folded over the entire assembly as seen in FIG. 12 after the latter is placed in shipping container 21. Finger holes 81 are provided in top flap 76 for raising of same and removal of the tubes VT from container 21.

It will be noted that the viewing screens are well spaced from the corners of the container 21, and that the faces of such screens are proteced both by the insert material and the container.

By reason of the fact that the necks of tubes VT1 and VT2 lying in one plane are disposed in reverse relationship, and that tubes VT3 and VT4 lying in the other plane are similarly disposed, with the axes of the tubes of one plane intersecting the tubes of the other plane, considerable saving in board material is achieved.

I claim:

1. An insert for a shipping container for isolating from the walls of said container a plurality of necked articles of commerce such as video tube envelopes having a viewing screen at one end and a neck at the other end, said insert being formed of a number of cut and scored blanks of paperboard and comprising:

(a) a first platform having opposed downturned flaps at the sides and ends thereof for supporting said platform in spaced relationship to a support surface;

(b) said platform having opposed pairs of openings conforming to the contour of said tube envelopes for cradling portions of said envelopes;

(c) said downturned flaps having extensions projecting upwardly therefrom for protection of the viewing screens of said envelopes.

(d) a center post extending through the center of said platform;

(e) two opposed sides of said center post having the necks of a pair of tubes extending therealong in a common plane;

(f) a guide supported on said center post for the necks of the aforesaid tubes and the necks of other tubes extending along other opposed sides of said center post and in a second common plane;

(g) a top panel and having cutout panels corresponding to the contours of the tube envelopes;

(h) a pair of opposed flaps extending from said top panel and foldable into position over that portion of the envelopes supporting the viewing screen thereof.

2. An insert according to claim 1 wherein said center post is provided with structure for supporting said platform.

3. An insert according to claim 1 wherein said guide is provided with flaps foldable into position for guiding the necks of said tubes.

4. An insert according to claim 1 wherein the axes of the tube necks in one plane lie perpendicular to the axes of the tube necks in the other plane.

5. An insert according to claim 1 wherein said openings from said platform are spaced from the corners of said container.

6. An insert according to claim 5 wherein said openings are provided with notches for the viewing screens of said tubes.

7. An insert for a shipping container for isolating from the walls of said container a plurality of necked articles of commerce such as video tube envelopes having a viewing screen at one end and a neck at the other end, said insert being formed of a number of cut and scored blanks of paperboard or the like and comprising:

(a) a platform supported in spaced relationship to a support surface;

(b) said platform having openings conforming to contours of said tube envelopes;

(c) a center post extending through said platform;

(d) two opposed sides of said center post having the necks of a pair of tubes extending therealong and resting upon said platform;

(e) a guide supported on said center post for the necks of said tubes and for the necks of other tubes lying in a plane lying above the plane of the first named pairs of necks and extending generally perpendicularly to said necks.

8. An insert according to claim 7 wherein said center post is provided with structure for supporting said platform.

9. An insert according to claim 7 wherein said guide is provided with flaps foldable into position for guiding the necks of said tubes.

10. An insert according to claim 7 wherein the axes of the tube necks in one plane lie perpendicular to the axes of the tube necks in the other plane.

11. An insert according to claim 7 wherein said cutouts from said platform are spaced from the corners of said container.

12. An insert according to claim 11 wherein said cutouts are provided with notches for the viewing screens of said tubes.

* * * * *